US012292058B2

(12) United States Patent
Miwata et al.

(10) Patent No.: US 12,292,058 B2
(45) Date of Patent: May 6, 2025

(54) VACUUM PUMP AND WATER COOLING SPACER

(71) Applicant: Edwards Japan Limited, Chiba (JP)

(72) Inventors: Tooru Miwata, Chiba (JP); Yoshiyuki Takai, Chiba (JP)

(73) Assignee: Edwards Japan Limited, Chiba (JP)

( * ) Notice: Subject to any disclaimer, the term of this patent is extended or adjusted under 35 U.S.C. 154(b) by 164 days.

(21) Appl. No.: 17/769,161

(22) PCT Filed: Oct. 27, 2020

(86) PCT No.: PCT/JP2020/040330
§ 371 (c)(1),
(2) Date: Apr. 14, 2022

(87) PCT Pub. No.: WO2021/085444
PCT Pub. Date: May 6, 2021

(65) Prior Publication Data

US 2023/0272806 A1 Aug. 31, 2023

(30) Foreign Application Priority Data

Oct. 28, 2019 (JP) ..... 2019-195540

(51) Int. Cl.
*F04D 29/58* (2006.01)
*F04D 19/04* (2006.01)

(52) U.S. Cl.
CPC ..... *F04D 29/582* (2013.01); *F04D 19/04* (2013.01); *F04D 19/042* (2013.01)

(58) Field of Classification Search
CPC ..... F04D 19/042; F04D 27/006; F04D 29/40; F04D 29/52; F04D 29/522; F04D 29/584
See application file for complete search history.

(56) References Cited

U.S. PATENT DOCUMENTS 3,620,854 A * 11/1971 Herbert, Jr. ..... C22C 21/10 148/404
5,180,283 A * 1/1993 Vickery, III ..... F04B 25/005 417/234

(Continued)

FOREIGN PATENT DOCUMENTS

EP 2952743 A1 * 12/2015 ..... F04D 19/002
JP H11280689 A 10/1999

(Continued)

OTHER PUBLICATIONS

PCT International Search Report dated Dec. 22, 2020 for corresponding PCT application Serial No. PCT/JP2020/040330, 2 pages.

(Continued)

*Primary Examiner* — Philip E Stimpert
(74) *Attorney, Agent, or Firm* — Theodore M. Magee; Westman, Champlin & Koehler, P.A.

(57) ABSTRACT

A vacuum pump is provided, which is capable of preventing a water cooling spacer, which is one component of a casing, from being damaged by destruction of an interior component. The vacuum pump includes a casing having an inlet port, a stator column provided upright inside the casing, and a rotating body shaped to surround an outer periphery of the stator column, with gas being sucked in from the inlet port by rotation of the rotating body, wherein the casing is composed of a plurality of components including a water cooling spacer having a water cooling pipe disposed therein, and the water cooling spacer is made of an aluminum alloy casting material having an elongation of 5% or more as a mechanical material property.

9 Claims, 5 Drawing Sheets

(56) References Cited

U.S. PATENT DOCUMENTS

| | | | | |
|---|---|---|---|---|
| 2015/0275914 | A1* | 10/2015 | Tsutsui | F04D 17/168<br>415/177 |
| 2015/0345499 | A1* | 12/2015 | Tsubokawa | F04D 29/522<br>415/177 |
| 2016/0222974 | A1* | 8/2016 | Sakaguchi | F04D 29/522 |
| 2017/0030371 | A1* | 2/2017 | Wilds | F04D 13/068 |

FOREIGN PATENT DOCUMENTS

| | | | |
|---|---|---|---|
| JP | 2002180988 | A | 6/2002 |
| JP | 2018096336 | A | 6/2018 |
| WO | 2019188732 | A1 | 10/2019 |

OTHER PUBLICATIONS

PCT International Written Opinion dated Dec. 22, 2020 for corresponding PCT application Serial No. PCT/JP2020/040330, 4 pages.

* cited by examiner

VACUUM PUMP AND WATER COOLING SPACER

CROSS-REFERENCE OF RELATED APPLICATION

This application is a Section 371 National Stage Application of International Application No. PCT/JP2020/040330, filed Oct. 27, 2020, which is incorporated by reference in its entirety and published as WO 2021/085444A1 on May 6, 2021 and which claims priority of Japanese Application No. 2019-195540, filed Oct. 28, 2019.

BACKGROUND

The present invention relates to a vacuum pump and a water cooling spacer used in a vacuum pump.

As a related art of the present technical field, for example, Japanese Patent Application Publication No. 2018-96336 discloses "a vacuum pump that includes a casing having an inlet port, a stator column provided upright inside the casing, a rotating body shaped to surround an outer periphery of the stator column, supporting means for rotatably supporting the rotating body, and driving means for driving the rotating body to rotate, wherein gas is sucked in from the inlet port by rotation of the rotating body, and the stator column is made of an aluminum alloy casting material having an elongation of 5% or more as a mechanical material property" (see the abstract).

According to Japanese Patent Application Publication No. 2018-96336, since the stator column is made of an aluminum alloy casting material with an elongation of 5% or more, even if the breaking energy of the rotating body acts on the stator column, the breaking energy can adequately be absorbed by the elongation of the stator column, preventing problems such as cracking of the stator column caused by the breaking energy, and scattering of broken pieces from the inlet port as a result of the destruction of the stator column.

The discussion above is merely provided for general background information and is not intended to be used as an aid in determining the scope of the claimed subject matter. The claimed subject matter is not limited to implementations that solve any or all disadvantages noted in the background.

SUMMARY

Incidentally, a vacuum pump may adopt a configuration in which an interior component is cooled by a water cooling spacer which is one component of a casing of the vacuum pump. Furthermore, a water cooling pipe is embedded inside such a water cooling spacer, so that the interior component of the vacuum pump is cooled by the water flowing through the water cooling pipe. In the case of this configuration, it is important at any rate to avoid scattering of debris and the like of an interior component of the vacuum pump to the outside of the casing, with the debris and the like being generated by the breaking energy of the rotating body. In addition, the debris may also act on the water cooling spacer, which is one component of the casing, thereby damaging the water cooling pipe. For example, if the water cooling pipe cracks, there is a concern that a semiconductor manufacturing apparatus or the like in which the vacuum pump is used will be exposed to water and break down. Therefore, when using a water cooling spacer as one component of the casing of the vacuum pump, the water cooling spacer is required to have higher reliability. However, Japanese Patent Application Publication No. 2018-96336 does not mention any technique of preventing the water cooling spacer from being damaged by the destruction of an interior component, and therefore has room for improvement.

The present invention has been made in view of the actual conditions described above, and a main object of the present invention is to provide a vacuum pump capable of preventing a water cooling spacer, which is one component of a casing, from being damaged by destruction of an interior component.

In order to achieve the foregoing object, the present invention provides a vacuum pump that includes a casing having an inlet port, a stator column provided upright inside the casing, and a rotating body shaped to surround an outer periphery of the stator column, with gas being sucked in from the inlet port by rotation of the rotating body, wherein the casing is composed of a plurality of components including a water cooling spacer having a water cooling pipe disposed therein, and the water cooling spacer is made of an aluminum alloy casting material having an elongation of 5% or more as a mechanical material property.

Also, in the above configuration, the casing may be configured to include a base located on a base end side thereof in an axial direction of the casing, a case located on a tip end side thereof, and the water cooling spacer located between the base and the case.

Furthermore, in the above configuration, the rotating body may include a plurality of moving blades arranged in multiple stages, the case may include a plurality of stator blades arranged in multiple stages so as to face the plurality of moving blades, and the water cooling spacer may be in direct or indirect thermal contact with at least one of the plurality of stator blades.

Also, in the above configuration, the casing may include therein a heater spacer for heating the gas sucked in from the inlet port, and the heater spacer may be located between the rotating body and the water cooling spacer.

Moreover, in the above configuration, vacuum pressure may act on an inner peripheral surface of the heater spacer, atmospheric pressure may act on an outer peripheral surface of the heater spacer and an inner peripheral surface of the water cooling spacer, and atmospheric pressure may act on an outer peripheral surface of the water cooling spacer.

Further, in the above configuration, the water cooling spacer may be positioned in a radial direction of the casing at the base end side in the axial direction of the casing, and a gap may be formed in the radial direction of the casing at least on the tip end side of the water cooling spacer and the heater spacer.

In addition, in the above configuration, the water cooling spacer may include a first flange portion located on the tip end side of the casing in the axial direction, a second flange portion located on the base end side, and a body portion connecting the first flange portion and the second flange portion, outer diameters of the first flange portion and the second flange portion may be larger than an outer diameter of the body portion so a step is formed between outer peripheral surfaces of the first and second flange portions and an outer peripheral surface of the body portion, the casing may be positioned in the radial direction by the second flange portion, and the water cooling pipe may be embedded in the first flange portion.

In the above configuration, vacuum pressure may act on the inner peripheral surface of the water cooling spacer, and atmospheric pressure may act on the outer peripheral surface of the water cooling spacer.

Furthermore, in order to achieve the foregoing object, another aspect of the present invention is a water cooling spacer that constitutes one component of a casing of a vacuum pump and cools an interior component of the vacuum pump, the water cooling spacer including a water cooling pipe disposed therein and being made of an aluminum alloy casting material having an elongation of 5% or more as a mechanical material property.

According to the present invention, it is possible to prevent the water cooling spacer from being damaged by the destruction of an interior component of a vacuum pump. Issues, configurations and effects other than those described above will be clarified by the following description of embodiments.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DETAILED DESCRIPTION

Embodiments the present invention are now described hereinafter with reference to the drawings.

First Embodiment

Figure 1:
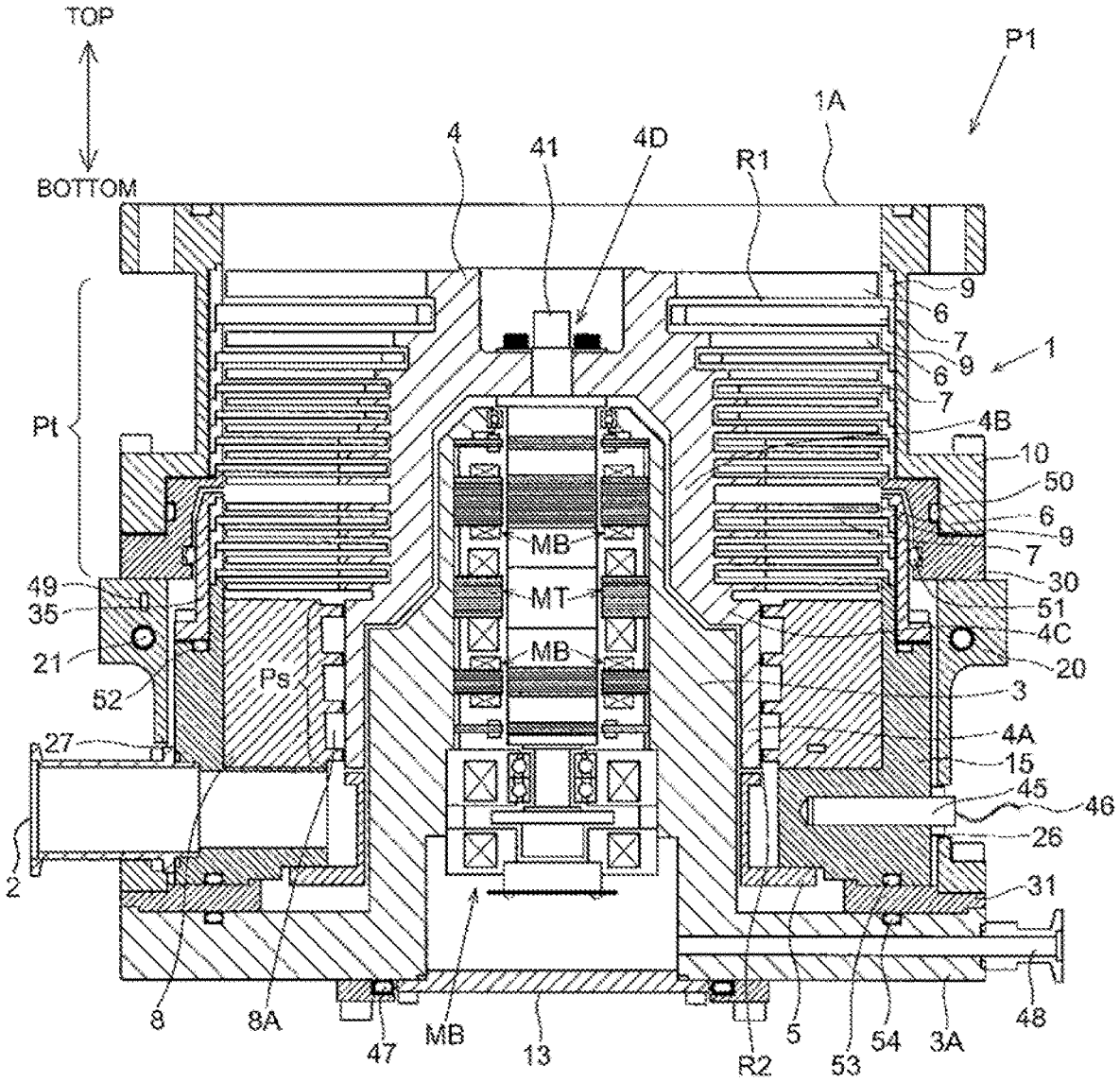
FIG. 1 is a cross-sectional view of a vacuum pump according to a first embodiment of the present invention.

FIG. 1 is a cross-sectional view of a vacuum pump according to a first embodiment of the present invention. As shown in FIG. 1, a vacuum pump P1 according to the first embodiment is a compound pump having a turbomolecular pump mechanism portion Pt and a thread groove pump mechanism portion Ps as gas exhaust mechanisms and is used as a gas exhaust means or the like for a process chamber or other enclosed chamber of, for example, a semiconductor manufacturing apparatus, a flat panel display manufacturing apparatus, and a solar panel manufacturing apparatus. Unless otherwise specified, a vertical direction is as shown in FIG. 1, where the lower side is the base end side and the upper side is the tip end side.

A casing 1 forms an outer shell of the vacuum pump P1 and is composed of a plurality of components. Specifically, the casing 1 includes an upper case (case) 10, an intermediate spacer 30, a water cooling spacer 20, a heat insulating spacer 31, and a base portion 3A. The casing 1 has a substantially cylindrical shape with the base portion 3A as a bottom portion, and various interior components described later are installed in an internal space of the casing 1. These components are arranged coaxially and integrally coupled by a fastening member such as bolts.

The height dimension of the vacuum pump P1 is determined by stacking the components in an axial direction from the base end side (lower side) to the tip end side (upper side). Therefore, for example, the water cooling spacer 20 functions as a component for positioning the vacuum pump P1 in a height direction. In the present embodiment, although the base portion 3A is integrated with a stator column 3, the base portion 3A and the stator column 3 may be separate bodies.

Further, in the present embodiment, a heat insulating spacer 35 and a heater spacer 15 (described later) are provided inside the intermediate spacer 30 and the water cooling spacer 20. The upper case 10 and the intermediate spacer 30 are sealed by a seal ring 50, the intermediate spacer 30 and the heat insulating spacer 35 are sealed by a seal ring 51, the heat insulating spacer 35 and the heater spacer 15 are sealed by a seal ring 52, the heater spacer 15 and the heat insulating spacer 31 are sealed by a seal ring 53, and the heat insulating spacer 31 and the base portion 3A are sealed by a seal ring 54. For the seal rings 50, 51, 52, 53, and 54, generally O-rings are used.

Therefore, vacuum pressure acts on an inner surface of the casing 1, that is, specifically, each of inner peripheral surfaces of the upper case 10, the intermediate spacer 30, the heat insulating spacer 35, the heater spacer 15, the heat insulating spacer 31, and the base portion 3A, and atmospheric pressure acts on an outer peripheral surface of the heater spacer 15 and an outer surface of the casing 1. Since the water cooling spacer 20 is arranged outside the heater spacer 15 and is shielded from the space where the vacuum pressure acts by the seal rings 51, 52, and 53, the pressure that acts on an inner peripheral surface and an outer peripheral surface of the water cooling spacer 20 is atmospheric pressure.

An upper end portion side of the upper case 10 is opened as an inlet port 1A, and an outlet port 2 is provided above the base portion 3A. Specifically, the casing 1 is configured to include the inlet port 1A and the outlet port 2. Although not shown, the inlet port 1A is connected to an enclosed chamber, not shown, which becomes high vacuum, such as a process chamber of a semiconductor manufacturing apparatus, while the outlet port 2 is communicated and connected with an auxiliary pump, also not shown.

Although the details of the water cooling spacer 20 will be described later, the water cooling spacer 20 is formed in a cylindrical shape, and a water cooling pipe 21 is arranged inside the water cooling spacer 20. The water cooling pipe 21 is arranged so as to go around substantially one circle along a circumferential direction. The water cooling spacer 20 is made of an aluminum alloy casting material having an elongation of 5% or more as a mechanical material property. In the present embodiment, for example, JIS AC4CH-T6 is used as the material of the aluminum alloy cast, but any material may be used as long as it is an aluminum alloy cast having an elongation of 5% or more.

The term "elongation" used herein refers to a ratio between the length of a test piece made of metal (aluminum alloy, in the present embodiment) that is generated upon breakage when being pulled by a tensile tester, and the original length of the test piece. Specifically, when the original length of the test piece is represented as L and the length of the test piece upon breakage is represented as $L+\Delta L$, the term "elongation" refers to a numerical value representing $\Delta L/L$ in percentage.

Further, the water cooling pipe 21 is formed from, for example, a stainless steel tube and is embedded in the water cooling spacer 20. Water flows through the water cooling pipe 21 to cool an interior component of the vacuum pump P1. In addition, various cooling media such as coolant may be used instead of water. In other words, the fluid flowing through the water cooling pipe 21 is not limited to water. The water cooling spacer 20 is in thermal contact with at least one of a plurality of stator blades 7, which are interior components, via the intermediate spacer 30, and the water flowing through the water cooling pipe 21 cools the plurality of stator blades 7.

Here, the term "thermal contact" used herein is synonymous with being connected so that heat can be exchanged. Therefore, it can be said that the stator blades 7 and the water cooling spacer 20 are configured to be able to exchange heat via the intermediate spacer 30. Of course, the stator blades 7 and the water cooling spacer 20 may be configured to be in direct contact with each other without having the intermediate spacer 30 therebetween. That is, a configuration is possible in which at least one of the plurality of stator blades 7 is in thermal contact with the water cooling spacer 20, and heat exchange is directly or indirectly performed therebetween, so that at least one of the plurality of stator blades 7 is cooled by the water cooling spacer 20. In other words, a configuration is possible in which the heat insulating member is not interposed between at least one of the plurality of stator blades 7 and the water cooling spacer 20. Reference numeral 49 is a temperature sensor for detecting the temperature of the water cooling spacer 20.

The stator column 3 is provided upright inside the casing 1. In particular, in the vacuum pump P1 of FIG. 1, the stator column 3 is located in a central portion inside the casing 1, and as described above, the flange-shaped base portion 3A integrally formed at the lower portion of the stator column 3 constituting the bottom portion of the casing 1.

A rotating body 4 is provided outside the stator column 3. Various electrical components, such as a magnetic bearing MB as support means for supporting the rotating body 4 in radial and axial directions thereof, and a drive motor MT as a driving means for driving the rotating body 4 to rotate, are embedded in the stator column 3. Since the magnetic bearing MB and the drive motor MT are well-known electrical components, detailed descriptions of the specific configurations of said electrical components are omitted.

The rotating body 4 is shaped to surround an outer periphery of the stator column 3. The rotating body 4 adopts a structure in which two cylindrical bodies with different diameters (a first cylindrical body 4A constituting the thread groove pump mechanism portion Ps and a second cylindrical body 4B constituting the turbomolecular pump mechanism portion Pt) are coupled to each other in a cylinder axial direction by a coupling portion 4C, a structure having a fastening portion 4D for fastening the second cylindrical body 4B and a rotating shaft 41 described hereinafter to each other, and a structure in which a plurality of moving blades 6 described hereinafter are arranged in multiple stages on an outer peripheral surface of the second cylindrical body 4B. Of course, the rotating body 4 is not limited to having these structures.

The rotating shaft 41 is provided inside the rotating body 4. The rotating shaft 41 is located inside the stator column 3 and fastened integrally to the rotating body 4 via the fastening portion 4D. The rotating body 4 is configured to be rotatably supported at a predetermined position in the axial and radial directions thereof by the magnetic bearing MB supporting the rotating shaft 41, and the rotating body 4 is also configured to be driven to rotate about a rotation center thereof (specifically, around the rotating shaft 41) by the drive motor MT rotating the rotating shaft 41. The rotating body 4 may be supported and driven to rotate using a different structure.

The vacuum pump P1 includes gas flow paths R1 and R2 as means for sucking gas in from the inlet port 1A by means of rotation of the rotating body 4 and exhausting the sucked gas from the outlet port 2 to the outside. Of the entire gas flow paths R1 and R2, the inlet-side gas flow path R1 (the upstream side of the coupling portion 4C of the rotating body 4) in the first half is configured by the plurality of moving blades 6 that are provided on the outer peripheral surface of the rotating body 4 and the plurality of stator blades 7 that are fixed to the inner peripheral surfaces of the upper case 10 and the heat insulating spacer 35 via spacers 9. The outlet-side gas flow path R2 (the downstream side of the coupling portion 4C of the rotating body 4) in the latter half is configured as a thread groove-like flow path by the outer peripheral surface of the rotating body 4 (specifically, an outer peripheral surface of the first cylindrical body 4A) and a thread groove pump stator 8 facing the outer peripheral surface of the rotating body 4.

The configuration of the inlet-side gas flow path R1 is now described in more detail. The plurality of moving blades 6 are arranged radially around a pump axial center (e.g., the rotation center of the rotating body 4, etc.). The plurality of stator blades 7, on the other hand, are arranged and fixed to the inner periphery of the upper case 10 and the heat insulating spacer 35 so as to be positioned in a pump radial direction and a pump axial direction via the spacers 9, and are arranged radially around the pump axial center. The moving blades 6 and the stator blades 7 that are arranged radially as described above configure the inlet-side gas flow path R1 by being arranged alternately in multiple stages along the direction of the pump axial center (vertical direction).

In the inlet-side gas flow path R1, the rotating body 4 and the plurality of moving blades 6 are rotated integrally at height speed by the activation of the drive motor MT. As a result, the moving blades 6 impart a downward momentum to gas molecules that have entered into the upper case 10 from the inlet port 1A. The gas molecules having such downward momentum are sent by the stator blades 7 to the moving blades 6 of the next stage. The step of imparting a momentum to gas molecules and the step of sending such gas molecules are repeated through the multiple stages, whereby the gas molecules present at the inlet port 1A are exhausted in such a manner as to sequentially shift toward the outlet-side gas flow path R2 through the inlet-side gas flow path R1.

The configuration of the outlet-side gas flow path R2 will be described next in more detail. The thread groove pump stator 8 is an annular fixing member surrounding a downstream-side outer peripheral surface of the rotating body 4 (specifically, the outer peripheral surface of the first cylindrical body 4A. The same is true hereinafter), and is disposed in such a manner that an inner peripheral surface thereof faces the downstream-side outer peripheral surface of the rotating body 4 via a predetermined gap therebetween.

Also, a thread groove 8A is formed in an inner peripheral portion of the thread groove pump stator 8. The thread groove 8A has a tapered cone shape in which the depth of the thread groove 8A becomes small toward the bottom of the thread groove pump stator 8, and is engraved in a spiral shape from an upper end of the thread groove pump stator 8 to a lower end of the same.

In the vacuum pump P1 of FIG. 1, the downstream-side outer peripheral surface of the rotating body 4 and the inner peripheral portion of the thread groove pump stator 8 being opposed to each other configure the outlet-side gas flow path R2 as a thread groove-like gas flow path. Another embodiment can employ a configuration in which the outlet-side gas flow path R2 described above is formed by, for example, providing the thread groove 8A on the downstream-side outer peripheral surface of the rotating body 4.

In the outlet-side gas flow path R2, when the rotating body 4 is rotated by the activation of the drive motor MT, the gas flows from the inlet-side gas flow path R1 and is exhausted in such a manner as to shift while being compressed from a transitional flow to a viscous flow by a drag effect between the thread groove 8A and the downstream-side outer peripheral surface of the rotating body 4.

The heater spacer 15 is located between the heat insulating spacer 31 and the heat insulating spacer 35 in the axial direction, and is provided so as to cover the outer peripheral surface of the thread groove pump stator 8. The heater spacer 15 is formed in a substantially cylindrical shape, and is made of a stainless steel material, for example, which has a small decrease in yield strength even at high temperatures and is unlikely to be deformed by heat. The heater spacer 15 is provided with a plurality of holes along the circumferential direction, and a heater 45, which is a heating source, is inserted into these holes. The heat of the heater 45 heats the thread groove pump stator 8 via the heater spacer 15 and heats the gas flowing through the outlet-side gas flow path R2. As a result, it is possible to prevent liquefaction and solidification of the gas flowing through the outlet-side gas flow path R2, preventing the gas molecules from accumulating in the outlet-side gas flow path R2 (particularly, the thread groove 8A). As a result, the rotating body 4 is prevented from being damaged by the gas molecules.

Furthermore, a support ring 5 is provided on the heater spacer 15. In the flow path from the exit of the outlet-side gas flow path R2 to the outlet port 2, the support ring 5 plays a role of separating the heated gas from a low temperature portion, i.e., the stator column 3 and the base portion 3A, so that, as mentioned later, the temperature of the gas does not drop and liquefies or solidifies by coming into contact with the low temperature portion.

As shown in FIG. 1, a bottom plate 13 is attached to the lower portion of the casing 1, and the magnetic bearing MB and the drive motor MT can be taken out by removing the bottom plate 13 at the time of maintenance. Reference numerals 47 and 48 indicate water cooling pipes, and the stator column 3 is cooled by a cooling medium such as water flowing through the water cooling pipes 47 and 48.

Figure 2:
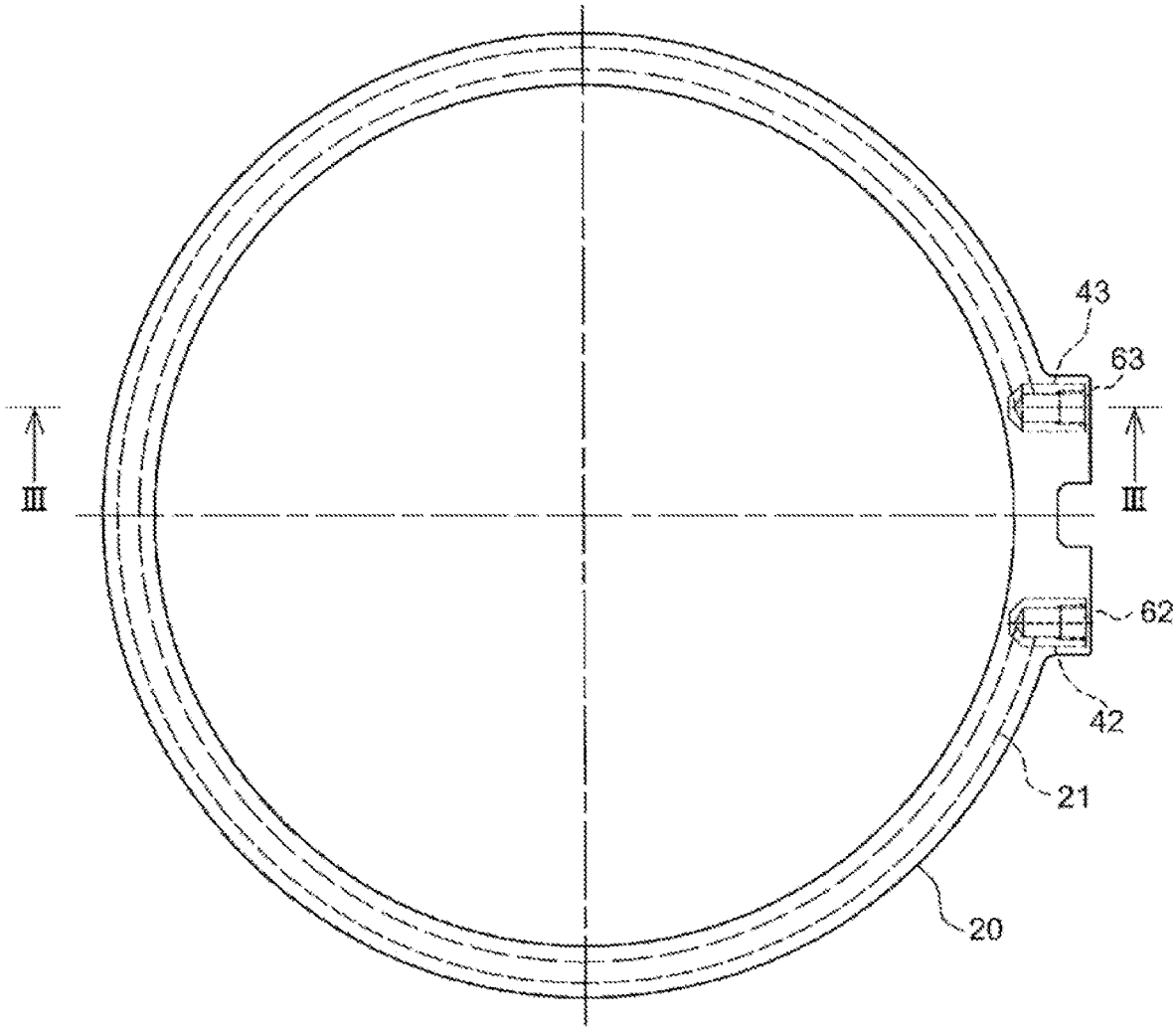
FIG. 2 is a plan view of a water cooling spacer illustrated in FIG. 1.
Figure 3:
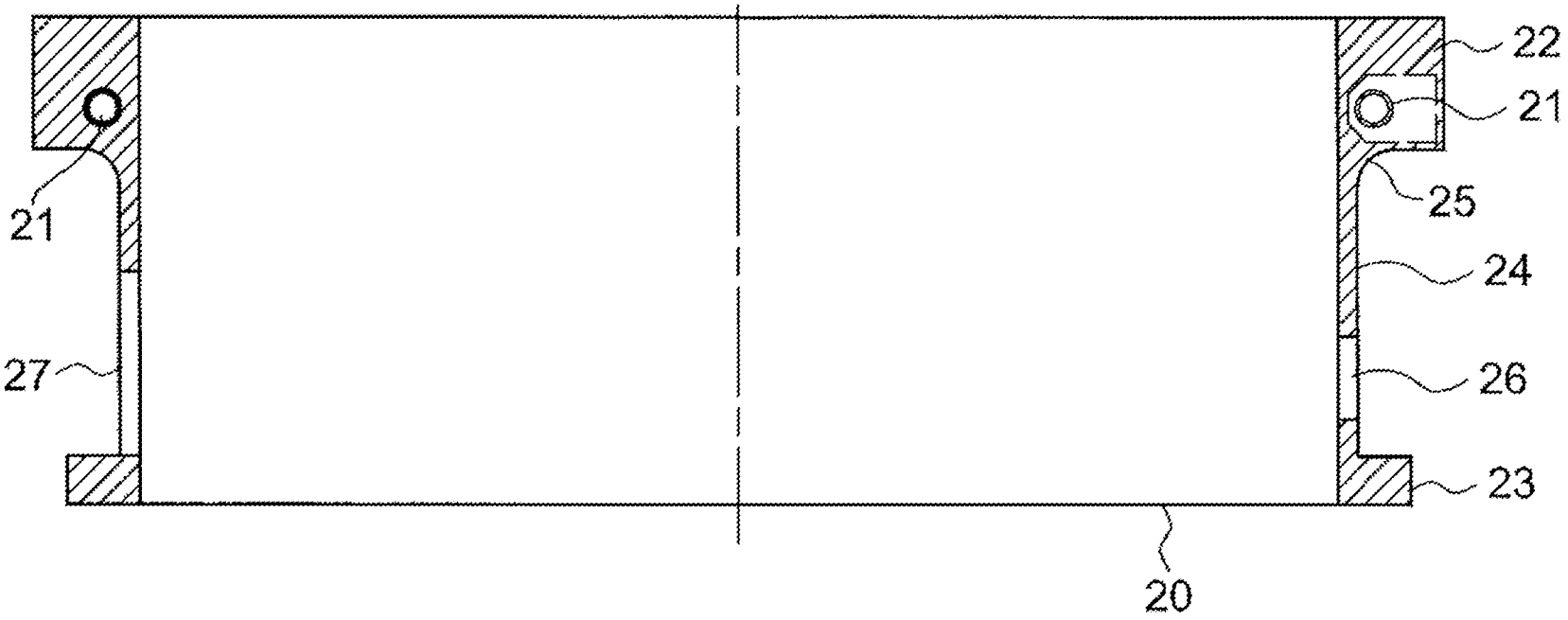
FIG. 3 is a cross-sectional view taken along III-III of FIG. 2.
Figure 4:
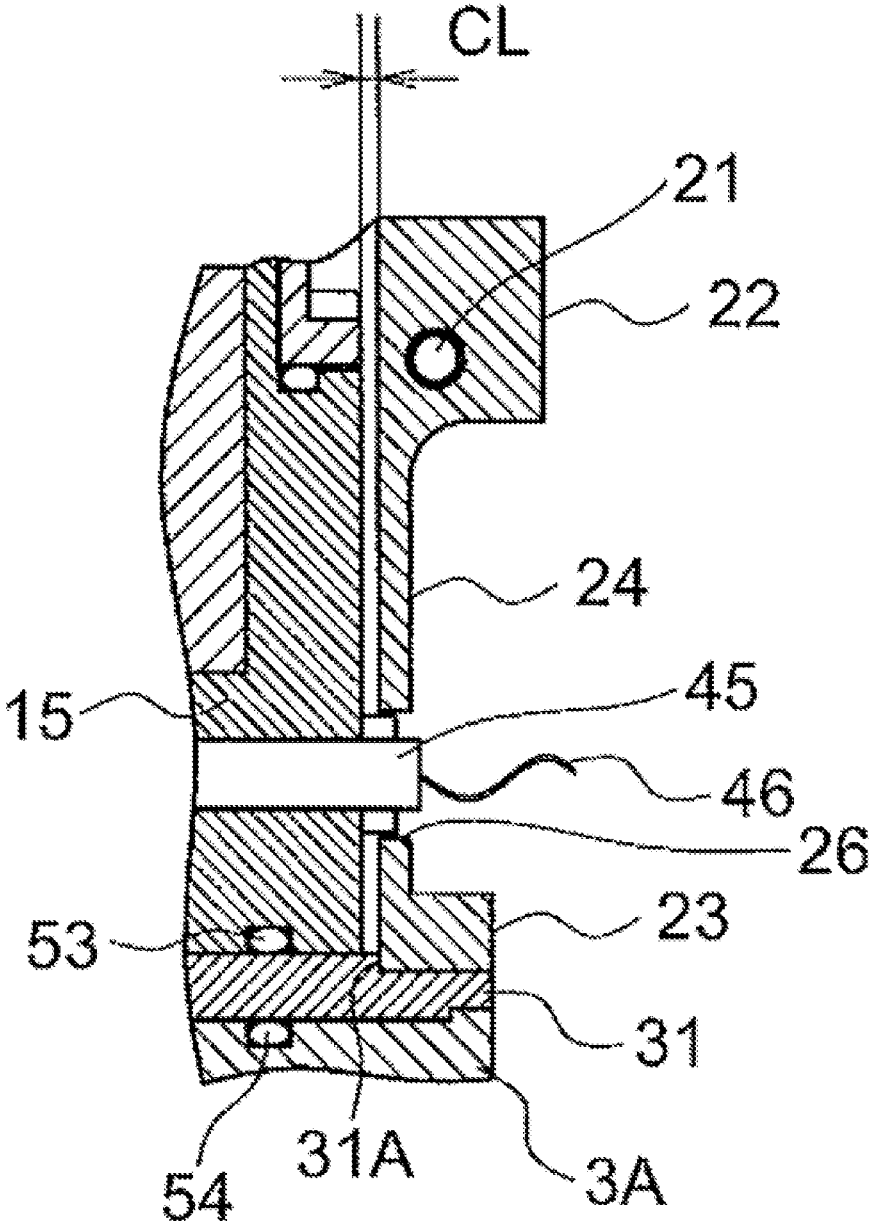
FIG. 4 is an enlarged view of a main part of FIG. 1.

Next, the shape of the water cooling spacer 20 will be described in detail with reference to FIGS. 2 and 3. FIG. 2 is a plan view of the water cooling spacer 20. FIG. 3 is a cross-sectional view taken along line III-III of FIG. 2. FIG. 4 is an enlarged view of a main part of FIG. 1. As shown in FIG. 2, a water cooling pipe 21 is embedded inside the water cooling spacer 20 so as to go around substantially one circle in the circumferential direction, and a water supply port 62 is provided at one of both ends of the water cooling pipe 21 and a drainage port 63 is provided at the other end. The water supply port 62 is provided with a joint 42, and the drainage port 63 is provided with a joint 43. The water cooling pipe 21 may be configured to go around in circles.

As shown in FIG. 3, the water cooling spacer 20 has an upper flange (first flange portion) 22, a body portion 24, and a lower flange (second flange portion) 23, wherein the water cooling pipe 21 is embedded in the upper flange 22. The outer diameter of the body portion 24 is smaller than the outer diameters of the upper flange 22 and the lower flange 23. Therefore, a step is formed due to the difference between the outer diameters of the upper flange 22 and the lower flange 23 and the outer diameter of the body portion 24. That is, the water cooling spacer 20 is formed to have a U-shaped cross section in which the body portion 24 is constricted.

The body portion 24 is provided with a hole 26 for inserting the heater 45 and a hole 27 for connecting the outlet port 2, and an electrical wire 46 (see FIG. 1) of the heater 45 is wound around the body portion 24. That is, the body portion 24 functions as a storage portion for storing the electrical wire 46 and the like. Since the electrical wire 46 is wound around the body portion 24, the electrical wire 46 does not protrude outside outer peripheral surfaces of the upper flange 22 and the lower flange 23.

A chamfered corner portion 25 is formed at the connection portion between the body portion 24 and the upper flange 22. This prevents cracks and the like from occurring in the connection portion between the body portion 24 and the upper flange 22.

Here, as shown in FIG. 4, the lower flange 23 of the water cooling spacer 20 is in abutment with a stepped portion 31A of the heat insulating spacer 31, and the stepped portion 31A positions the water cooling spacer 20 in the radial direction. As a result, a gap CL of, for example, approximately 1 mm is formed between the water cooling spacer 20 and the heater spacer 15 in the radial direction. This gap CL is provided to suppress the transfer of heat between the water cooling spacer 20 having a low temperature and the heater spacer 15 having a high temperature, and is provided over the entire height direction (axial direction) of the water cooling spacer 20. However, the gap CL may be formed at least on the upper flange 22 side (tip end side) where the water cooling pipe 21 is embedded.

Actions and effects of the vacuum pump P1 according to the first embodiment configured as described above will be described next.

Since the water cooling spacer 20 is made of an aluminum alloy casting material with an elongation of 5% or more, even if the breaking energy of the rotating body 4 acts on the water cooling spacer 20, the breaking energy can adequately be absorbed by the elongation of the water cooling spacer 20, preventing broken pieces of an interior component generated as a result of the destruction of the rotating body 4 (e.g., broken pieces of the rotating body 4 itself, broken pieces of the stator column 3, chunks containing broken pieces of an electrical component such as the drive motor MT and broken pieces of the stator column 3, and the like) from scattering to the outside. Moreover, since the water cooling spacer 20 is made of an aluminum alloy casting material, the manufacturing cost of the water cooling spacer 20 can be suppressed. Moreover, since the pressure acting on the inner peripheral surface and the outer peripheral surface of the water cooling spacer 20 is atmospheric pressure, it is not necessary to configure the water cooling spacer 20 with a pressure-resistant member. Therefore, the cost of the water cooling spacer 20 can be further reduced.

Also, since the gap CL is formed between the heater spacer 15 and the water cooling spacer 20, even if the impact caused by the breakage of an interior component is transmitted to the heater spacer 15, the impact is absorbed by the gap CL. As a result, it becomes difficult for the impact to be transmitted to the water cooling spacer 20, thereby preventing cracks and damage from occurring in the water cooling pipe 21.

Since the lower flange 23 of the water cooling spacer 20 and the stepped portion 31A of the heat insulating spacer 31 are in abutment with each other, there is a possibility that the impact caused by the breakage of an interior component is transmitted to the lower flange 23 via the heat insulating spacer 31. Even in this case, since the water cooling pipe 21 is embedded in the upper flange 22 and is separated from the lower flange 23 on which the impact acts, the impact on the water cooling pipe 21 is alleviated. As a result, it is possible to reduce the damage to the water cooling pipe 21.

As described above, according to the first embodiment, a highly reliable vacuum pump P1 can be obtained.

Second Embodiment

Figure 5:
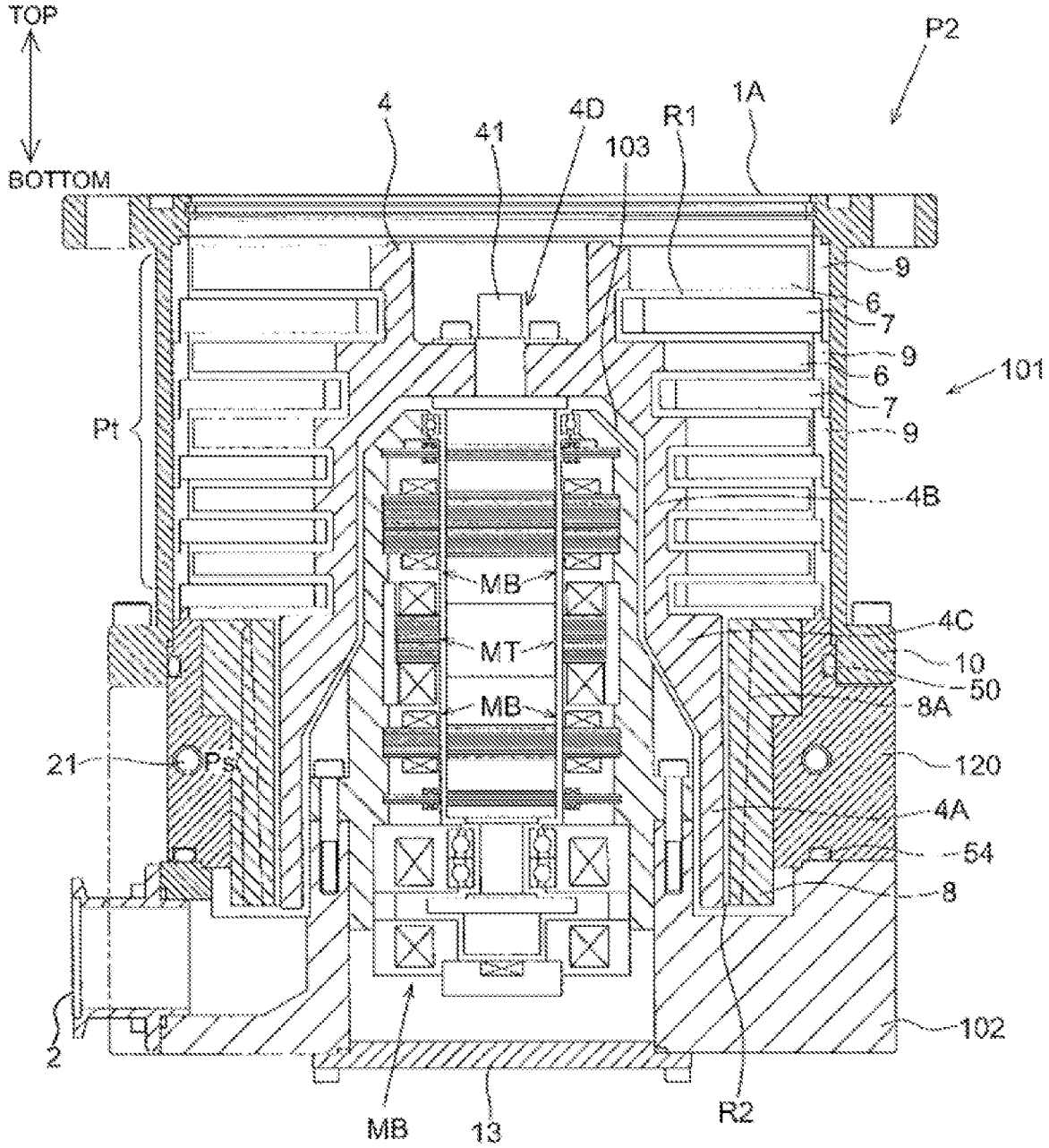
FIG. 5 is a cross-sectional view of a vacuum pump according to a second embodiment of the present invention.

FIG. 5 is a cross-sectional view of a vacuum pump according to a second embodiment of the present invention. A vacuum pump P2 according to the second embodiment is different from the vacuum pump P1 according to the first embodiment mainly in that the vacuum pump P2 does not include the heater 45 and the heater spacer 15. Therefore, the differences therebetween will be mainly described below, and the same components as those in the first embodiment will be designated by the same reference numerals and the description thereof will be omitted accordingly.

As shown in FIG. 5, a casing 101 of the vacuum pump P2 according to the second embodiment includes the upper case 10, a water cooling spacer 120, and a base portion 102. The casing 101 has a substantially cylindrical shape with the base portion 102 as a bottom portion, and various interior components described below are installed in an internal space of the casing 101. These components are arranged coaxially and integrally coupled by a fastening member such as bolts.

In addition, in the present embodiment, the upper case 10 and the water cooling spacer 120 are sealed by the seal ring 50, and the water cooling spacer 120 and the base portion 102 are sealed by the seal ring 54.

Thus, vacuum pressure acts on the inner surface of the casing 101, that is, specifically, the inner peripheral surfaces of the upper case 10, the water cooling spacer 120, and the base portion 102, and atmospheric pressure acts on the outer peripheral surface of the casing 101. Therefore, in the second embodiment, the magnitude of the pressure acting on the inner peripheral surface of the water cooling spacer 120 is different from that acting on the outer peripheral surface of the same. Therefore, the water cooling spacer 120 needs to be designed in consideration of the vacuum pressure, and the material of the water cooling spacer 120 is an aluminum alloy casting material with an elongation of 5% or more, and a material satisfying this design condition is used.

In the second embodiment, a stator column 103 is configured as a separate body from the base portion 102, and the stator column 103 is mounted on the base portion 102.

According to the vacuum pump P2 of the second embodiment, since the water cooling spacer 120 is made of an aluminum alloy casting material with an elongation of 5% or more, the same action and effect as those of the first embodiment can be achieved. In particular, since the vacuum pump P2 according to the second embodiment does not require the heater spacer 15, the number of components can be reduced as compared with the vacuum pump P1 of the first embodiment, and therefore cost reduction can be realized. Thus, the vacuum pump P2 according to the second embodiment is suitable in an environment where there is no concern about liquefaction or solidification of the gas flowing through the outlet-side gas flow path R2.

The present invention is not limited to the foregoing embodiments, and various modifications can be made without departing from the gist of the present invention. All the technical matters included in the technical idea described in the claims are the subject of the present invention. Although the foregoing embodiments have illustrated favorable examples, those skilled in the art can realize various alternatives, corrections, modifications, or improvements from the details disclosed in the present specification, and these are included in the technical scope set forth in the appended claims.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump, comprising:

a casing having an inlet port;

a stator column provided upright inside the casing; and a rotating body shaped to surround an outer periphery of the stator column, with gas being sucked in from the inlet port by rotation of the rotating body, wherein the casing is composed of a plurality of components including a water cooling spacer having a water cooling pipe disposed therein, the water cooling spacer is made of an aluminum alloy casting material having an elongation of 5% or more as a mechanical material property, the casing includes therein a heater spacer for heating the gas sucked in from the inlet port, the water cooling spacer includes a first flange portion, a body portion and a second flange portion, the first flange portion located on a tip end side of the body portion in the axial direction, and the second flange portion located on a base end side of the body portion, the body portion is provided with a hole for inserting a heater attached to the heater spacer, the hole being a radially oriented through hole through which the heater is inserted into the heater spacer, the hole being disposed axially between the first flange portion and the second flange portion spacer, outer diameters of the first flange portion and the second flange portion are larger than an outer diameter of the body portion so a step is formed between outer peripheral surfaces of the first and second flange portions and an outer peripheral surface of the body portion, and the body portion functions as a storage portion for storing an electrical wire of the heater inserted in the hole by winding such that the electrical wire of the heater does not protrude radially outside the outer peripheral surfaces of the first and second flange portions.

2. The vacuum pump according to claim 1, wherein the casing is composed of a base located on a base end side thereof in an axial direction of the casing, a case located on a tip end side thereof, and the water cooling spacer located between the base and the case.

3. The vacuum pump according to claim 2, wherein the rotating body includes a plurality of moving blades arranged in multiple stages, the case includes a plurality of stator blades arranged in multiple stages so as to face the plurality of moving blades, and the water cooling spacer is in direct or indirect thermal contact with at least one of the plurality of stator blades.

4. The vacuum pump according to claim 1, wherein the heater spacer is located between the rotating body and the water cooling spacer.

5. The vacuum pump according to claim 4, wherein vacuum pressure acts on an inner peripheral surface of the heater spacer, atmospheric pressure acts on an outer peripheral surface of the heater spacer and an inner peripheral surface of the water cooling spacer, and atmospheric pressure acts on an outer peripheral surface of the water cooling spacer.

6. The vacuum pump according to claim 4, wherein the water cooling spacer is positioned in a radial direction of the casing on the base end side in the axial direction of the casing, and a gap is formed in the radial direction of the casing at least on the tip end side of the water cooling spacer and the heater spacer.

7. The vacuum pump according to claim 6, wherein the casing is positioned in the radial direction by the second flange portion, and the water cooling pipe is embedded in the first flange portion.

8. The vacuum pump according to claim 1, wherein vacuum pressure acts on the inner peripheral surface of the water cooling spacer, and atmospheric pressure acts on the outer peripheral surface of the water cooling spacer.

9. A vacuum pump, comprising:

a casing having an inlet port;

a stator column provided upright inside the casing; and a rotating body shaped to surround an outer periphery of the stator column, with gas being sucked in from the inlet port by rotation of the rotating body, wherein the casing is composed of a plurality of components including a water cooling spacer having a water cooling pipe disposed therein, the water cooling spacer is made of an aluminum alloy casting material having an elongation of 5% or more as a mechanical material property, the casing includes therein a heater spacer for heating the gas sucked in from the inlet port, the water cooling spacer includes a first flange portion, a body portion and a second flange portion, the first flange portion located on a tip end side of the body portion in the axial direction, and the second flange portion located on a base end side of the body portion and receiving a fastener, the body portion is provided with a hole for inserting a heater attached to the heater spacer, the hole being a radially oriented through hole through which the heater is inserted into the heater spacer, the hole being disposed axially between the first flange portion and the second flange portion spacer, outer diameters of the first flange portion and the second flange portion are larger than an outer diameter of the body portion so a step is formed between outer peripheral surfaces of the first and second flange portions and an outer peripheral surface of the body portion, and the body portion functions as a storage portion for storing an electrical wire of the heater inserted in the hole by winding such that the electrical wire of the heater does not protrude radially outside the outer peripheral surfaces of the first and second flange portions.

* * * * *